US008375720B2

(12) United States Patent
Pekrul

(10) Patent No.: US 8,375,720 B2
(45) Date of Patent: Feb. 19, 2013

(54) PLASMA-VORTEX ENGINE AND METHOD OF OPERATION THEREFOR

(76) Inventor: Merton W. Pekrul, Mesa, AZ (US)

( * ) Notice: Subject to any disclaimer, the term of this patent is extended or adjusted under 35 U.S.C. 154(b) by 94 days.

(21) Appl. No.: 12/705,731

(22) Filed: Feb. 15, 2010

(65) Prior Publication Data

US 2010/0139613 A1 Jun. 10, 2010

Related U.S. Application Data

(63) Continuation of application No. 11/388,361, filed on Mar. 24, 2006, now Pat. No. 7,694,520, which is a continuation-in-part of application No. 11/077,289, filed on Mar. 9, 2005, now Pat. No. 7,055,327.

(51) Int. Cl.
*F01K 25/08* (2006.01)
*F01C 21/00* (2006.01)

(52) U.S. Cl. ..... 60/651; 60/671; 418/158; 418/243; 418/259

(58) Field of Classification Search ..... 60/643, 60/645, 651, 670, 671; 418/158, 243, 259
See application file for complete search history.

(56) References Cited

U.S. PATENT DOCUMENTS

| | | | | |
|---|---|---|---|---|
| 122,713 | A | | 1/1872 | Faucett |
| 1,953,378 | A | | 4/1934 | Vias |
| 2,588,342 | A | | 3/1952 | Bidwell |
| 3,183,843 | A | | 5/1965 | Cockburn |
| 3,237,528 | A | | 3/1966 | Rose |
| 3,295,752 | A | | 1/1967 | Bellmer |
| 3,381,891 | A | | 5/1968 | Bellmer |
| 3,516,769 | A | | 6/1970 | Korhonen |
| 3,539,281 | A | | 11/1970 | Kramer |
| 3,585,973 | A | * | 6/1971 | Klover ..... 123/243 |
| 3,809,020 | A | | 5/1974 | Takitani |
| 3,883,277 | A | | 5/1975 | Keller |
| 3,915,598 | A | | 10/1975 | Kalen |
| 3,950,950 | A | | 4/1976 | Doerner |
| 3,958,422 | A | | 5/1976 | Kelly |
| 3,970,051 | A | | 7/1976 | Kirkman |
| 3,975,914 | A | | 8/1976 | Tufts |
| 3,976,037 | A | | 8/1976 | Hojnowski |
| 3,986,483 | A | | 10/1976 | Larson |
| 4,005,951 | A | | 2/1977 | Swinkels |
| 4,033,299 | A | | 7/1977 | Manzoni |
| 4,033,300 | A | | 7/1977 | Larson |
| 4,046,493 | A | | 9/1977 | Alund |
| 4,047,856 | A | | 9/1977 | Hoffman |
| 4,064,841 | A | | 12/1977 | Jenkins |
| 4,106,472 | A | | 8/1978 | Rusk |
| 4,115,045 | A | | 9/1978 | Wyman |
| 4,132,512 | A | * | 1/1979 | Roberts ..... 418/23 |
| 4,168,941 | A | | 9/1979 | Rettew |
| 4,178,900 | A | | 12/1979 | Larson |
| 4,191,032 | A | | 3/1980 | August |
| 4,203,410 | A | | 5/1980 | Ramer |
| 4,242,065 | A | | 12/1980 | Ishizuka |

(Continued)

*Primary Examiner* — Hoang Nguyen
(74) *Attorney, Agent, or Firm* — Kevin Hazen

(57) ABSTRACT

A plasma-vortex engine (20) provided. The engine (20) consists of a plasmatic fluid (22) circulating in a closed loop (44) encompassing a fluid heater (26), an expansion chamber (30), and a condenser (42). The expansion chamber (30) is fabricated of magnetic material, and encompasses a rotor (72), fabricated of non-magnetic material, to which T-form vanes (114), also fabricated of non-magnetic material, are coupled. A shaft (36) is coupled to the rotor (72). During operation, the plasmatic fluid (22) is heated to produce a plasma (86) within the expansion chamber (30). The plasma (86) is expanded and a vortex (100) generated therein to exert a plasmatic force (93) against the vanes (114). The rotor (72) and shaft (36) rotate in response to the plasmatic force (93). A plurality of magnets (115,119) are embedded in the vanes (114) and rotor (72) to provide attractive and repulsive forces (97,99,101) and better seal the vane (114) to the expansion chamber (30).

21 Claims, 11 Drawing Sheets

U.S. PATENT DOCUMENTS 4,290,268 A 9/1981 Lowther
4,353,337 A 10/1982 Rosaen
4,355,965 A 10/1982 Lowther
4,367,629 A 1/1983 Cann
4,399,863 A 8/1983 Banasiuk
4,437,308 A 3/1984 Fischer
4,486,158 A 12/1984 Maruyama
4,492,541 A 1/1985 Mallen-Herrero
4,502,853 A * 3/1985 Ohi ..... 418/2
4,515,123 A 5/1985 Taylor
4,548,171 A 10/1985 Larson
4,580,950 A 4/1986 Sumikawa
4,638,776 A 1/1987 Crittenden
4,721,079 A 1/1988 Lien
4,760,701 A 8/1988 David
4,804,317 A 2/1989 Smart
4,813,388 A 3/1989 Yang
4,817,567 A 4/1989 Wilks
4,860,704 A 8/1989 Slaughter
5,027,654 A * 7/1991 Bergamini ..... 73/259
5,039,290 A 8/1991 Nardi
5,116,208 A 5/1992 Parme
5,181,844 A 1/1993 Bishop
5,224,850 A 7/1993 Pie
5,235,945 A 8/1993 Testea
5,277,158 A 1/1994 Pangman
5,336,047 A 8/1994 Kolhouse
5,359,966 A 11/1994 Jensen
5,379,736 A 1/1995 Anderson
5,408,824 A 4/1995 Schlote
5,419,691 A 5/1995 Lien
5,501,586 A 3/1996 Edwards
5,524,587 A 6/1996 Mallen
5,540,199 A 7/1996 Penn
5,558,511 A 9/1996 Hedelin
5,567,139 A 10/1996 Weatherston
5,571,005 A 11/1996 Stoll
5,571,244 A 11/1996 Andres
5,634,783 A 6/1997 Beal
5,681,153 A 10/1997 Weatherston
5,720,251 A 2/1998 Round
5,755,196 A 5/1998 Klassen
5,758,501 A 6/1998 Jirnov
5,794,583 A 8/1998 Ichieda
5,937,820 A 8/1999 Nagata
5,946,916 A 9/1999 Ven
5,968,378 A 10/1999 Jensen
6,006,009 A 12/1999 Friedheim
6,030,195 A * 2/2000 Pingston ..... 418/82
6,036,463 A 3/2000 Klassen
6,070,565 A 6/2000 Miniere
6,086,347 A 7/2000 Ryska
6,106,255 A 8/2000 Viegas
6,164,263 A 12/2000 Saint-Hilaire
6,169,852 B1 1/2001 Liao
6,247,443 B1 6/2001 Pelleja
6,354,262 B2 3/2002 Wade
6,364,646 B1 4/2002 Kirtley
6,497,557 B2 12/2002 Aden
6,530,211 B2 3/2003 Holtzapple
6,546,908 B1 4/2003 Pekau
6,565,310 B1 5/2003 Davidow
6,589,033 B1 7/2003 Johnson
6,594,997 B2 7/2003 Romanelli
6,601,570 B2 8/2003 Zetmeir
6,634,873 B2 10/2003 Klassen
6,659,065 B1 12/2003 Renegar
6,722,182 B1 4/2004 Buettner
6,729,296 B2 5/2004 King
6,732,525 B2 * 5/2004 Endoh et al. ..... 60/618
6,739,852 B1 5/2004 Klassen
6,772,728 B2 8/2004 Al-Hawaj
6,773,226 B2 8/2004 Al-Hawaj
6,786,036 B2 9/2004 Kight
6,799,549 B1 10/2004 Patterson
6,886,527 B2 5/2005 Regev
6,899,075 B2 5/2005 Saint-Hilaire
7,055,327 B1 * 6/2006 Pekrul et al. ..... 60/651
7,073,477 B2 7/2006 Gorski
7,255,083 B2 8/2007 Hamada
7,341,041 B2 3/2008 Pekau
7,395,805 B1 7/2008 MacMurray
7,412,831 B2 8/2008 Ullyott
7,578,278 B2 8/2009 Peitzke
7,674,101 B2 3/2010 Maeng
7,694,520 B2 * 4/2010 Pekrul et al. ..... 60/651
7,707,987 B2 5/2010 Guthrie
7,713,042 B1 5/2010 Rodgers
7,845,332 B2 12/2010 Wang
2006/0102139 A1 5/2006 Garcia
2008/0041056 A1 2/2008 Carnahan

* cited by examiner

82

PLASMA-VORTEX ENGINE AND METHOD OF OPERATION THEREFOR

CROSS REFERENCES TO RELATED PATENT APPLICATIONS

The present invention is a continuation of U.S. patent application Ser. No. 11/388,361 filed Mar. 24, 2006, now U.S. Pat. No. 7,694,520 which is a continuation-in-part of "PLASMA-VORTEX ENGINE AND METHOD OF OPERATION THEREFOR", U.S. patent application Ser. No. 11/077,289, filed Mar. 9, 2005, now U.S. Pat. No. 7,055,327, all of which are incorporated herein in their entirety by this reference thereto.

TECHNICAL FIELD OF THE INVENTION

The present invention relates to the field of rotary engines. More specifically, the present invention relates to the field of external-combustion rotary engines.

BACKGROUND OF THE INVENTION

The controlled expansion of gases forms the basis for the majority of non-electrical rotational engines in use today. These engines include reciprocating, rotary, and turbine engines, and may be driven by heat (heat engines) or other forms of energy. Heat engines may use combustion, solar, geothermal, nuclear, or other forms of thermal energy. Combustion-based heat engines may utilize either internal or external combustion.

Internal-combustion engines derive power from the combustion of a fuel within the engine itself. Typical internal-combustion engines include reciprocating engines, rotary engines, and turbine engines.

Internal-combustion reciprocating engines convert the expansion of burning gases (typically, an air-fuel mixture) into the linear movement of pistons within cylinders. This linear movement then converted into rotational movement through connecting rods and a crankshaft. Examples of internal-combustion reciprocating engines are the common automotive gasoline and diesel engines.

Internal-combustion rotary engines use rotors and chambers to more directly convert the expansion of burning gases into rotational movement. An example of an internal-combustion rotary engine is the Wankel engine, which utilizes a triangular rotor that revolves in a chamber, instead of pistons within cylinders. The Wankel engine has fewer moving parts and is generally smaller and lighter, for a given power output, than an equivalent internal-combustion reciprocating engine.

Internal-combustion turbine engines direct the expansion of burning gases against a turbine, which then rotates. An example of an internal-combustion turbine engine is a turboprop aircraft engine, in which the turbine is coupled to a propeller to provide motive power for the aircraft.

Internal-combustion turbine engines are often used as thrust engines, where the expansion of the burning gases exit the engine in a controlled manner to produce thrust. An example of an internal-combustion turbine/thrust engine is the turbofan aircraft engine, in which the rotation of the turbine is typically coupled back to a compressor, which increases the pressure of the air in the air-fuel mixture and markedly increases the resultant thrust.

All internal-combustion engines of this type suffer from poor efficiency. Only a small percentage of the potential energy is released during combustion, i.e., the combustion is invariably incomplete. Of that energy released in combustion, only a small percentage is converted into rotational energy. The rest must be dissipated as heat.

If the fuel used is a typical hydrocarbon or hydrocarbon-based compound (e.g., gasoline, diesel oil, or jet fuel), then the partial combustion characteristic of internal-combustion engines causes the release of a plethora of combustion by-products into the atmosphere in the form of an exhaust. In order to reduce the quantity of pollutants, a support system consisting of a catalytic converter and other apparatuses is often necessitated. Even when minimized, a significant quantity of pollutants is released into the atmosphere as a result of incomplete combustion.

Because internal-combustion engines depend upon the rapid (i.e., explosive) combustion of fuel within the engine itself, the engine must be engineered to withstand a considerable amount of pressure and heat. These are drawbacks that require a more robust and more complex engine over external-combustion engines of similar power output.

External-combustion engines derive power from the combustion of a fuel in a combustion chamber separate from the engine. A Rankine-cycle engine typifies a modern external-combustion engine. In a Rankine-cycle engine, fuel is burned in the combustion chamber and used to heat a liquid at substantially constant pressure. The liquid is vaporized to become the desired gas. This gas is passed into the engine, where it expands. The desired rotational power is derived from this expansion. Typical external-combustion engines also include reciprocating engines, rotary engines, and turbine engines.

External-combustion reciprocating engines convert the expansion of heated gases into the linear movement of pistons within cylinders. This linear movement is then converted into rotational movement through linkages. The conventional steam locomotive engine is an example of an external-combustion open-loop Rankine-cycle reciprocating engine. Fuel (wood, coal, or oil) is burned in a combustion chamber (the firebox) and used to heat water at a substantially constant pressure. The water is vaporized to become the desired gas (steam). This gas is passed into the cylinders, where it expands to drive the pistons. Linkages (the drive rods) couple the pistons to the wheels to produce rotary power. The expanded gas is then released into the atmosphere in the form of steam. The rotation of the wheels propels the engine down the track.

External-combustion rotary engines use rotors and chambers instead of pistons, cylinders, and linkage to more directly convert the expansion of heated gases into rotational movement.

External-combustion turbine engines direct the expansion of heated gases against a turbine, which then rotates. A modern nuclear power plant is an example of an external-combustion closed-loop Rankine-cycle turbine engine. Nuclear fuel is "burned" in a combustion chamber (the reactor) and used to heat water. The water is vaporized to become the desired gas (steam). This gas is directed against a turbine, which then rotates. The expanded steam is then condensed back into water and made available for reheating. The rotation of the turbine drives a generator to produce electricity.

External-combustion engines may be made much more efficient than corresponding internal-combustion engines. Through the use of a combustion chamber, the fuel may be more thoroughly consumed, releasing a significantly greater percentage of the potential energy. More thorough consumption means fewer combustion by-products and a significant reduction in pollutants.

Because external-combustion engines do not themselves encompass the combustion of fuel, they may be engineered to operate at a lower pressure and a lower temperature than comparable internal-combustion engines. This in turn allows the use of less complex support systems (e.g., cooling and exhaust systems), and results in simpler and lighter engines for a give power output.

Typical turbine engines operate at high rotational speeds. This high rotational speed presents several engineering challenges that typically result in specialized designs and materials. This adds to system complexity and cost. Also, in order to operate at low-to-moderate rotational speeds, turbine engines typically utilize a step-down transmission of some sort. This, too, adds to system complexity and cost.

Similarly, reciprocating engines require linkage to convert linear motion to rotary motion. This results in complex designs with many moving parts. In addition, the linear motion of the pistons and the motions of the linkages produce significant vibration. This vibration results in a loss of efficiency and a decrease in engine life. To compensate, components are typically counterbalanced to reduce vibration. This results in an increase in both design complexity and cost.

Typical heat engines depend upon the diabatic expansion of the gas. That is, as the gas expands, it loses heat. This diabatic expansion represents a loss of energy.

What is needed, therefore, is an external-combustion rotary heat engine that maximizes and utilizes the adiabatic expansive energy of the gases.

SUMMARY OF THE INVENTION

Accordingly, it is an advantage of the present invention that a plasma-vortex engine and method of operation therefor are provided.

It is another advantage of the present invention that an external-combustion plasma-vortex engine is provided that utilizes external combustion.

It is another advantage of the present invention that a rotary plasma-vortex engine is provided.

It is another advantage of the present invention that a plasma-vortex engine is provided that utilizes vapor hydraulics.

It is another advantage of the present invention that a plasma-vortex engine is provided that utilizes adiabatic gas expansion.

It is another advantage the present invention that a plasma-vortex engine is provided that operates at moderate temperatures and pressures.

The above and other advantages of the present invention are carried out in one form by a plasma-vortex engine incorporating a plasmatic fluid configured to become a plasma upon vaporization thereof, a fluid heater configured to heat the plasmatic fluid, an expansion chamber formed of a housing, a first end plate coupled to the housing, and a second end plate coupled to the housing in opposition to the first end plate, a shaft incoincidentally coupled to the expansion chamber, a rotor coaxially coupled to the shaft within the expansion chamber, a plurality of vanes pivotally coupled to either the expansion chamber or the rotor, and a vortex generator coupled to the expansion chamber and configured to generate a plasma vortex within the expansion chamber.

The above and other advantages of the present invention are carried out in one form by a method of operating a plasma-vortex engine, wherein the method includes heating a plasmatic fluid, introducing a plasma derived from the plasmatic fluid into an expansion chamber, expanding the plasma adiabatically, exerting an expansive force upon one of a plurality of vanes within the expansion chamber in response to the expanding activity, rotating one of a rotor and a housing in response to the exerting activity, and exhausting the plasma from the expansion chamber.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
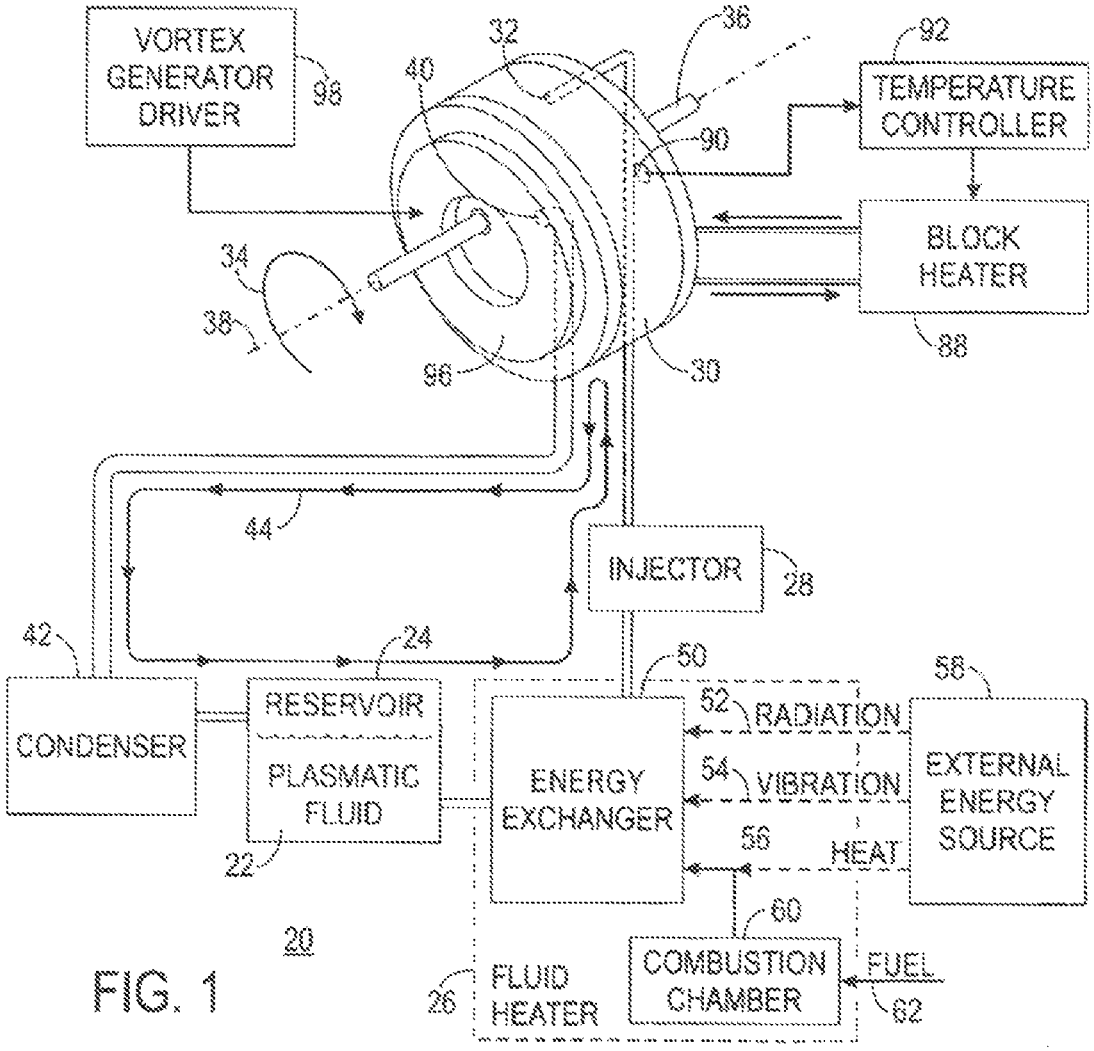
FIG. 1 shows a schematic view of a plasma-vortex engine in accordance with a preferred embodiment of the present invention.

FIG. 1 shows a schematic view of a plasma-vortex engine 20 in accordance with a preferred embodiment of the present invention. The following discussion refers to FIG. 1.

Plasma-vortex engine 20 is desirably configured as a closed-loop external combustion engine, e.g., a Rankine-cycle engine. That is, a plasmatic fluid 22 from a reservoir 24 is heated by a fluid heater 26 to become a plasma (discussed hereinafter). An injector 28 introduces the plasma into an expansion chamber 30 through an inlet port 32. Within expansion chamber 30, vapor hydraulics, adiabatic expansion, and vortical forces (discussed hereinafter) cause rotation 34 of a shaft 36 about a shaft axis 38. The plasma is then exhausted from expansion chamber 30 through an outlet port 40. The exhausted plasma is condensed back into plasmatic fluid 22 by a condenser 42 and returns to reservoir 24. This process continues as long as engine 20 is operational in a closed loop 44.

Those skilled in the art will appreciate that, some embodiments, an open-loop system may be desirable. In an open-loop system, condenser 42 is omitted and the exhausted plasma is vented to outside the system (e.g., to the atmosphere). The use of an open-loop embodiment does not depart from the spirit of the present invention.

Figure 2:
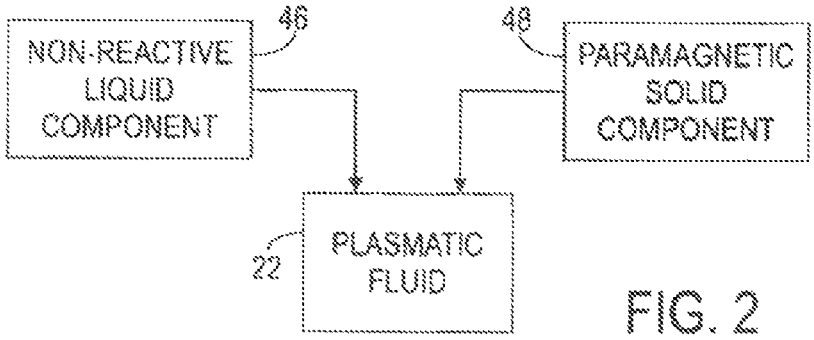
FIG. 2 shows a block diagram of the composition of a plasmatic fluid for the plasma-vortex engine of FIG. 1 accordance with a preferred embodiment of the present invention.

FIG. 2 shows a block diagram of the composition of a plasmatic fluid for plasma-vortex engine 20 in accordance with a preferred embodiment of the present invention. The following discussion refers to FIGS. 1 and 2.

Plasmatic fluid 22 is composed of a non-reactive liquid component 46 to which has been added a solid component 48. Solid component 48 is particulate and is effectively held in suspension within the liquid component 46. Liquid and solid components 46 and 48 desirably have a low coefficient of vaporization and a high heat transfer characteristic. These properties would make plasmatic fluid 22 suitable for use in a closed-loop engine with moderate operating temperatures, i.e., below 400° C. (750° F.), and at moderate pressures.

Liquid component 46 is desirably a diamagnetic liquid, (e.g. a liquid whose permeability is less than that of a vacuum, and which, when placed in a magnetic field, has an induced magnetism in a direction opposite to that of a ferromagnetic material). One possible such liquid is a non-polluting fluorocarbon, such as Fluorinert liquid FC-77® produced by 3M.

In other embodiments, liquid component 46 may desirably be a fluid that goes to a vapor phase at a very low temperature and has a significant vapor expansion characteristic. Typical of such liquids are nitrogen and ammonia.

Solid component 48 is desirably a particulate paramagnetic substance (e.g., a substance and in which the magnetic moments of the atoms are not aligned, and that, when placed in a magnetic field, possesses magnetization in direct proportion to the field strength. One possible such substance is powdered magnetite ($Fe_3O_4$).

Plasmatic fluid 22 may also contain other components, such as an ester-based fuel reformulator, a seal lubricant and/or an ionic salt.

Plasmatic fluid 22 desirably consists of a diamagnetic liquid in which a particulate paramagnetic solid is suspended. When plasmatic fluid 22 is vaporized, the resulting vapor will carry a paramagnetic charge, and sustain its ability to be affected by an electromagnets field. That is, the gaseous form of plasmatic fluid 22 is a plasma.

The following discussion refers to FIG. 1.

Plasmatic fluid 22 is heated to become a plasma by fluid heater 26. More specifically, plasmatic fluid 22 is heated by an energy exchanger 50 within fluid heater 26. Energy exchanger 50 is configured to exchange or convert an input energy into thermal energy, and to heat plasmatic fluid with that thermal energy. The exchange and conversion of energy may be accomplished by electrical, mechanical, or fluidic means without departing from the spirit of the present invention.

The input energy for energy exchanger 50 may be any desired form of energy. For example, preferred input energies may include, but are not limited to, radiation 52 (e.g. solar or nuclear), vibration 54 (e.g., acoustics, cymatics, and sonoluminescence), and heat 56 obtained from an external energy source 58. Heat 56 may be conveyed to energy exchanger 50 by radiation, convection, and/or conduction.

Plasma-vortex engine 20 is an external-combustion engine. This may be taken theoretically to mean simply that the consumption of fuel takes place outside of engine 20. This is the case when the input energy is such that there is no combustion (e.g. solar energy).

Conversely, "external-combustion engine" may be taken literally to mean that there is an external combustion chamber 60 coupled to energy exchanger 50. This is one preferred embodiment of, the present invention. In this embodiment, fuel 62 is consumed within combustion chamber 60 by combustion (i.e., fuel 62 is burned). Heat 56 generated by this combustion becomes the input energy for energy exchanger 50.

The combustion-chamber embodiment of the present invention is desirable for use in a multiplicity of applications. In a motor vehicle, for example, fuel 62 may be hydrogen and oxygen, liquefied natural gas, or any common (and desirably non-polluting) inflammable substance. As another example, in a fixed installation of engine 20, fuel 62 may be natural gas, oil, or desulphurized powdered coal. In any case, fuel 62 is burned in combustion chamber 60 and the resultant heat 56 is used to heat plasmatic fluid 22 in energy exchanger 50.

Figure 3:
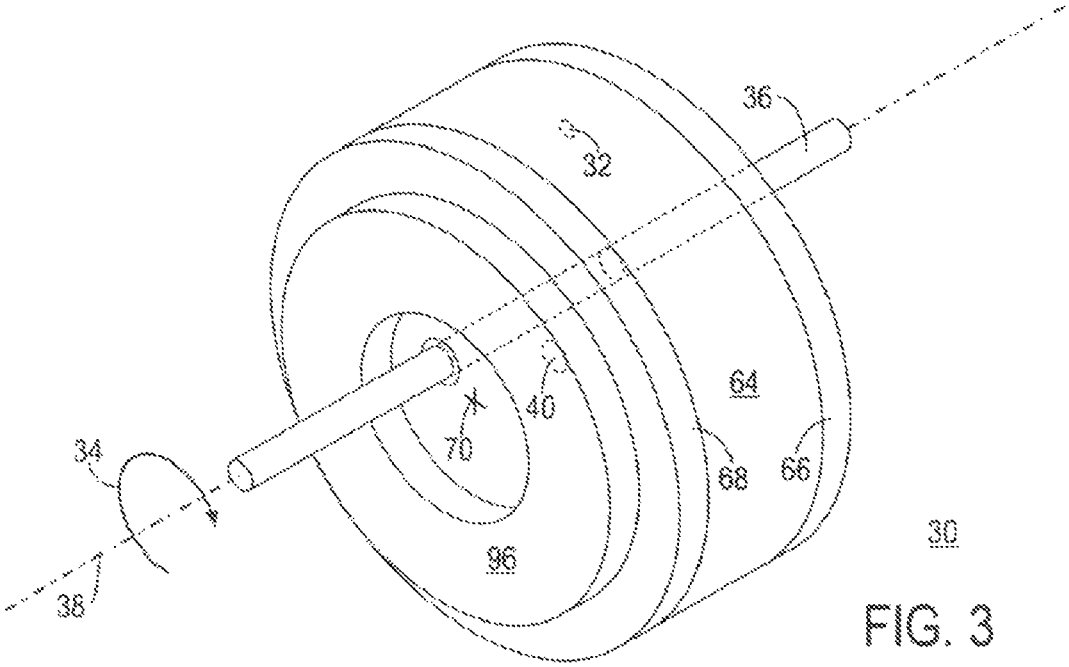
FIG. 3 shows an isometric external view of an expansion chamber for the plasma-vortex engine of FIG. 1 in accordance with a preferred embodiment of the present invention.
Figure 4:
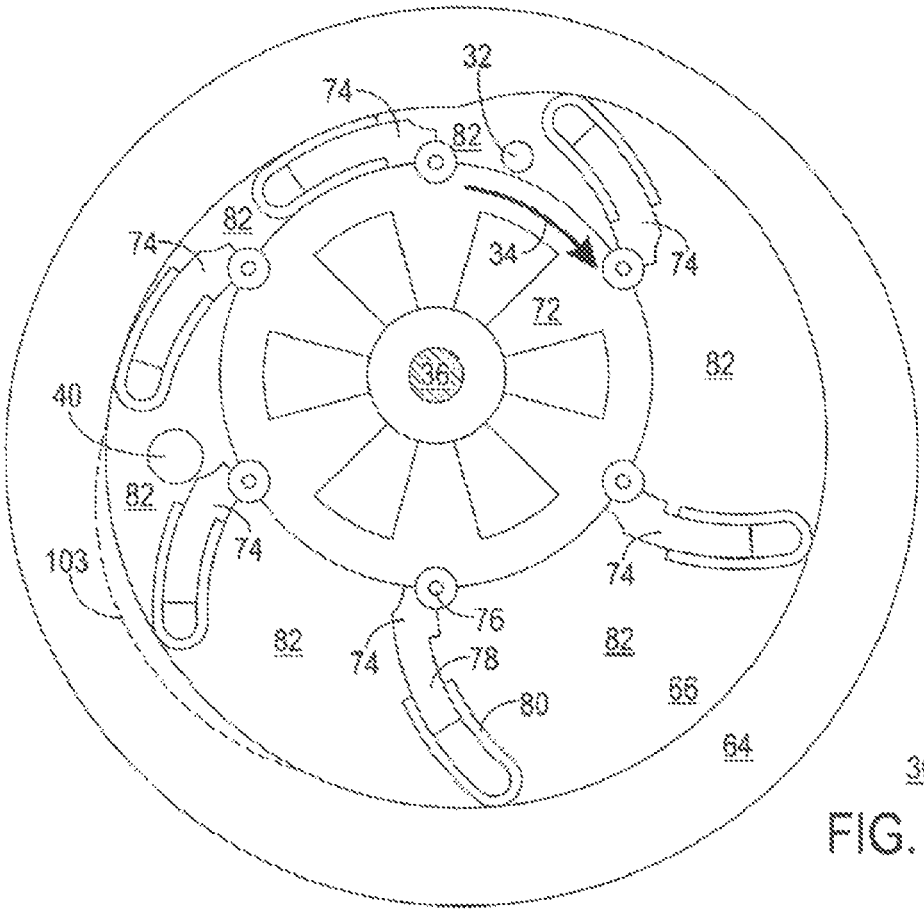
FIG. 4 shows a side view of the expansion chamber of FIG. 3 with pivotal vanes and with one end plate removed in accordance with a preferred embodiment of the present invention.

FIGS. 3 and 4 show an external isometric view and an internal side view, respectively, of expansion chamber 30 in accordance with a preferred embodiment of the present invention. The following discussion refers to FIGS. 1, and 3, and 4.

Expansion chamber 30 is formed of a housing 64, a first end plate 66 affixed to housing 64, and a second end plate 68 affixed to housing 64 in opposition to first end plate 66. FIG. 4 depicts a side view of expansion chamber 30 with second end plate 68 removed.

Those skilled in the art will appreciate that the use of two end plates 66 and 68 is not a requirement of the present invention. Either one of end plates 66 and 68 may be integrally formed with housing 64 without departing from the spirit of the present invention.

A shaft 36 is incoincidentally coupled to expansion chamber 30 (i.e., coupled so that an axis 38 of shaft 36 does not pass through a center 70 of expansion chamber 30). As depicted in FIGS. 1 and 3, shaft 36 passes through both of end plates 66 and 68. Those skilled in the art will appreciate that this is not a requirement of the present invention. Shaft 36 may terminate in one end plate 66 or 68 (and pass through the other end plate 68 or 66, respectively) without departing from the spirit of the present invention.

A rotor 72 is encompassed within expansion chamber 30 and coaxially coupled to shaft 36. A plurality of vanes 74 are pivotally coupled to rotor 72, housing 64, or one of end plates 66 or 68. Each of vanes 74 is made up of a vane pivot 76, a vane body 78, and a vane slide 80. Rotor 72 and each of vanes 74 also incorporate seals (not shown). The seals allow rotor 72 and vanes 74 to maintain sufficient sealing contact with end plates 66 and 68, and vanes 74 with either housing 64 or rotor 72, so as to provide adequate containment of the expanding plasma.

In the embodiment of FIG. 4, vanes 74 are pivotally coupled to rotor 72, and rotor 72 is fixedly coupled to shaft 36. When engine 20 is in operation, pressure upon vanes 74 causes rotor 72 to rotate (housing 64 does not rotate). This in turn causes rotation of shaft 36. As rotor 72 rotates, each vane 74 pivots outward to maintain contact with housing 64. At some point, the "contracted" length of vane 74 is insufficient to maintain contact with housing 64. Therefore, vane slide 80 slides over vane body 78 to increase the length of vane 74 and maintain contact.

In an alternative embodiment (not shown in the Figures), vanes 74 are pivotally coupled to housing 64 or one of end plates 66 or 68, and one or both of end plates 66 and 68 is fixedly coupled to shaft 36. When engine 20 is in operation, pressure upon vanes 74 causes housing 64 to rotate. As rotor 72 rotates freely on shaft 36, it functions as a type of gear and guide for vanes 74. As rotor 72 rotates, each vane 74 pivots inward to maintain contact with rotor 72. At some point, the "contracted" length of vane 74 is insufficient to maintain contact. Therefore, vane slide 80 slides over vane body 78 to increase the length of vane 74 and maintain contact.

Those skilled in the art will appreciate that whether rotor 72 or housing 64 rotates is moot. For the purposes of this discussion, it will be assumed that shaft 36 is fixedly coupled to rotor 72. The use of alternative embodiments does not depart from the spirit of the present invention.

Figure 5:
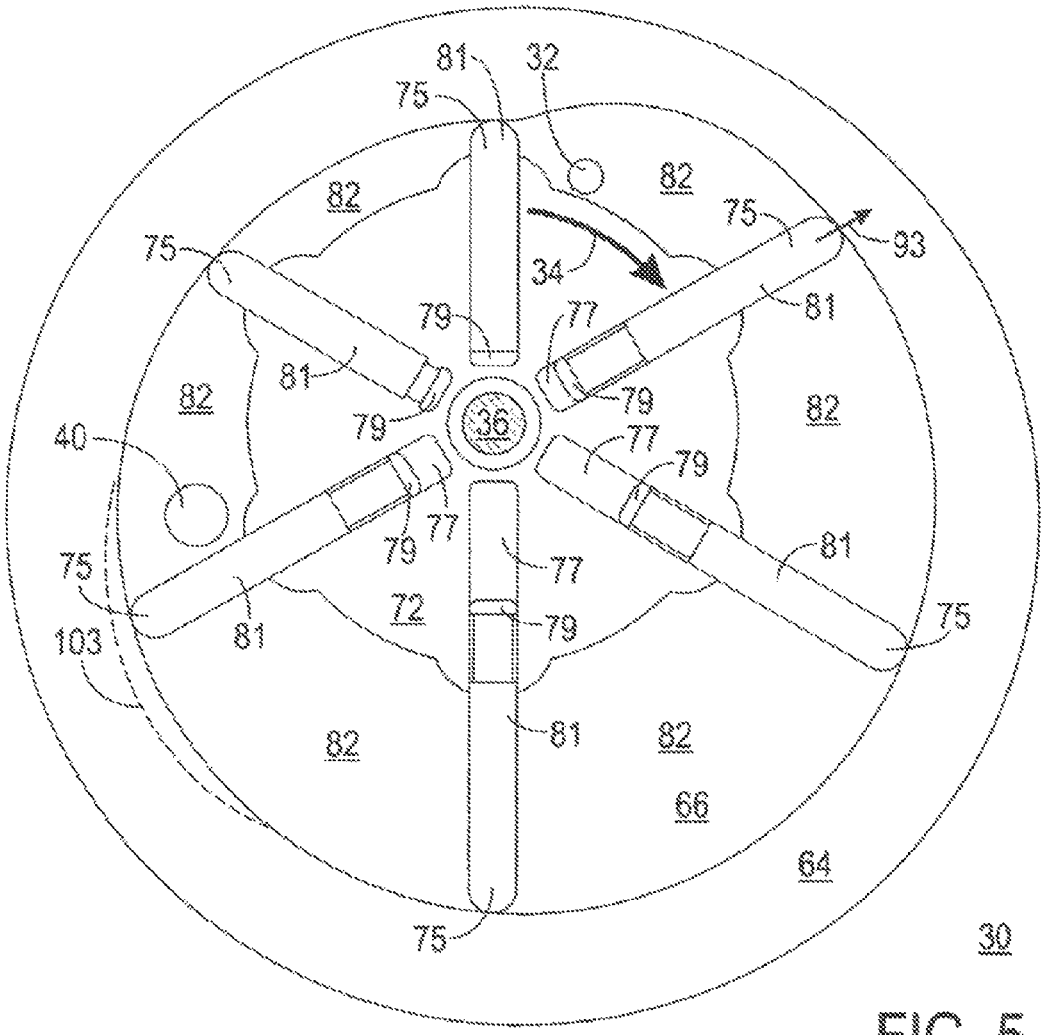
FIG. 5 shows a side view of the expansion chamber of FIG. 3 with sliding vanes and with one end plate removed in accordance with a preferred embodiment of the present invention.

FIG. 5 shows a side view of an alternative embodiment of expansion chamber 30 with sliding vanes 75 and one end plate 66 or 68 removed in accordance with a preferred embodiment of the present invention. The following discussing refers to FIGS. 1 and 5.

A rotor 72 is encompassed within expansion chamber 30 and coaxially coupled to shaft 36. Rotor 72 has a plurality of vane channels 77. Within each vane channel 77 is located a vane 75. Vanes 75 are slidingly coupled to rotor 72 through vane channel 77. That is each vane 75 is configured to slide within vane channel 77. Each of vanes 75 is made up of a vane base 79 and a vane extension 81. Each of vanes 75 also incorporates seals (not shown). The seals allow vanes 75 to maintain a sufficiently sealed contact with housing 64 and end plates 66 and 68.

In the embodiment of FIG. 5, vanes 75 are slidingly coupled to rotor 72, and rotor 72 is fixedly coupled to shaft 36. When engine 20 is in operation, pressure upon vanes 75 causes rotor 72 to rotate (housing 64 does not rotate). This in turn causes rotation of shaft 36. As rotor 72 rotates, each vane 75 slides outward to maintain contact with housing 64. At some point, the "contracted" length of vane 75 is insufficient to maintain contact with housing 64. Therefore, vane extension 81 slides over vane base 79 to increase the length of vane 75 and maintain contact.

For the purposes of this discussion, it will be assumed that the embodiment of FIG. 4, i.e. having vanes 74 pivotally coupled to rotor 72, and shaft 36 fixedly coupled to rotor 72.

Figure 6:
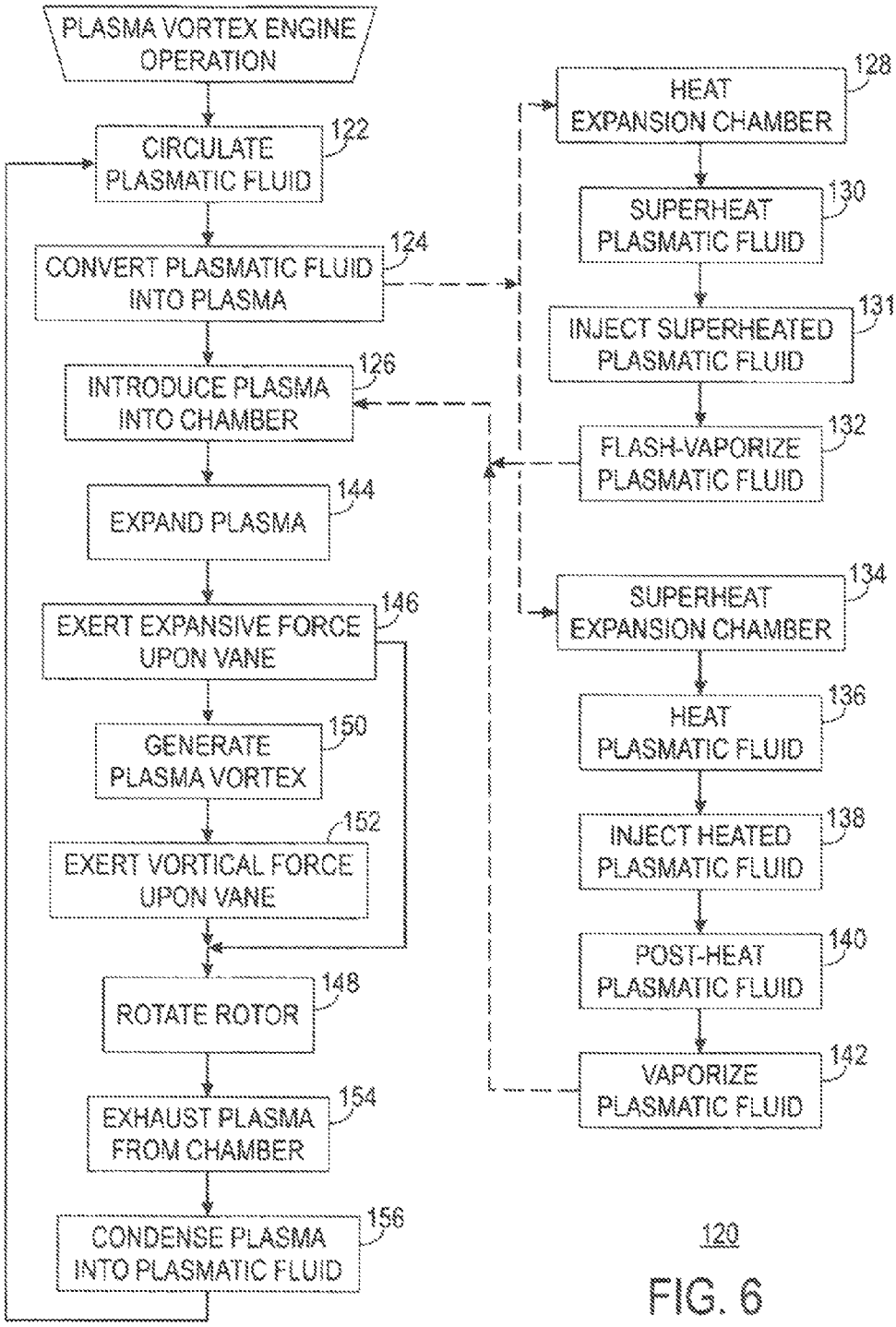
FIG. 6 shows a flow chart of a process for operation of the plasma-vortex engine of FIG. 1 in accordance with a preferred embodiment of the present invention.

FIG. 6 shows a flow chart of a process 120 for the operation of plasma-vortex engine 20 in accordance with a preferred embodiment of the present invention. FIGS. 7, 8, 9, 10, 11, and 12 show side views of expansion chamber 30 (with one end plate removed) during operation, and depicting a plurality of expansion cells 82 within expansion chamber 30 with a reference cell 821 at a 1 o'clock position (FIG. 7), a 3 o'clock position (FIG. 8), a 5 o'clock position (FIG. 9), at a 7 o'clock position (FIG. 10), at a 9 o'clock position (FIG. 11), and an 11 o'clock position (FIG. 12) in accordance with a preferred embodiment of the present invention. The following discussion refers to FIGS. 1, 2, 3, 6, 7, 8, 9, 10, 11, and 12.

Process 120 describes the operation of plasma-vortex engine 20. Throughout operation process 120, a parent task 122 circulates plasmatic fluid 22 around closed loop 44. During a portion of closed loop 44, plasmatic fluid 22 exists as a plasma 86.

Plasmatic fluid 22 passes from reservoir 24 to fluid heater 26. In a task 124, fluid heater 26 converts plasmatic fluid 22 into plasma 86. In a task 126 (FIG. 7) plasma 86 is introduced to expansion chamber 30.

Tasks 124 and 126 are intertwined and work together in one of two different scenarios.

In the first scenario, in a task 128, a block heater 88 heats expansion chamber 30 to a desired operating temperature. One or more sensors 90 detect the temperature of expansion chamber 30 and couple to a temperature controller 92, which in turn causes block heater 88 to maintain expansion chamber 30 at the desired temperature throughout operation process 120. Those skilled in the art will appreciate that block heater 88 may be a heat extractor configured to utilize excess heat from fluid heater 26 to heat expansion chamber 30.

In a task 130, fluid heater 26 superheats plasmatic fluid 22. That is, fluid heater 26 heats plasmatic fluid 22 to a temperature greater than or equal to a vapor-point temperature of plasmatic fluid 22.

In a task 131, injector 28 injects plasmatic fluid 22 into a cell 82 of expansion chamber 30 through inlet port 32. Because plasmatic fluid 22 is superheated, plasmatic fluid 22 flash-vaporizes to become plasma 86 in a task 132 substantially simultaneously with injection task 131.

In the second scenario, in a task 134, block heater 88 heats expansion chamber 30 to an operating temperature in excess of the vapor-point temperature of plasmatic fluid 22.

Expansion chamber 30 is maintained at this temperature throughout operation process 120 by the action of sensor(s) 90, temperature controller 92, and block heater 88.

In a task 136, fluid heater 26 heats plasmatic fluid 22 to a temperature proximate but less than the vapor-point temperature of plasmatic fluid 22.

In a task 138, injector 28 injects plasmatic fluid 22 into a cell 82 of expansion chamber 30 through inlet port 32. Because expansion chamber 30 has a temperature in excess of the vapor-point temperature of plasmatic fluid 22, injection into cell 82 causes plasmatic fluid 22 to be post-heated to the temperature of expansion chamber 30 in a task 140. This in turn causes plasmatic fluid 22 to vaporize and become plasma 86 in a task 142.

In either scenario, plasma 86 now resides within a cell 82 of expansion chamber 30. For the purposes of this discussion, this specific cell 82 shall be referred to as reference cell 821. Reference cell 821 exists at the 1 o'clock position (i.e. from vane pivot 76 at the 12 o'clock position to vane pivot 76 at the 2 o'clock position) in FIG. 7, and rotates clockwise through the 3 o'clock, 5 o'clock, 7 o'clock, 9 o'clock, and 11 o'clock positions in FIGS. 8, 9, 10, 11, and 12, respectively.

When plasma 86 is introduced into reference cell 821 (FIG. 7), plasma 86 begins to expand hydraulically and adiabatically in a task 144. This begins the power cycle of engine 20. In a task 146 the hydraulic and adiabatic expansion of plasma 86 exerts an expansive force 94 upon a leading vane 741 (i.e., upon that vane 74 bordering reference cell 821 in the direction of rotation 34). This causes, in a task 148, leading vane 741 to move in the direction of rotation 34. This in turn results in the rotation 34 of rotor 72 and shaft 36.

In a task 150, a vortex generator 96, driven by a vortex generator driver 98, generates a vortex 100 (FIGS. 8, 9, and 10) in plasma 86 within reference cell 821. In a task 152, vortex 100 exerts a vortical force 102 upon leading vane 741. Vortical force 102 adds to expansive force 94 and contributes to rotation 34 of rotor 72 and shaft 36 (task 148).

Figure 7:
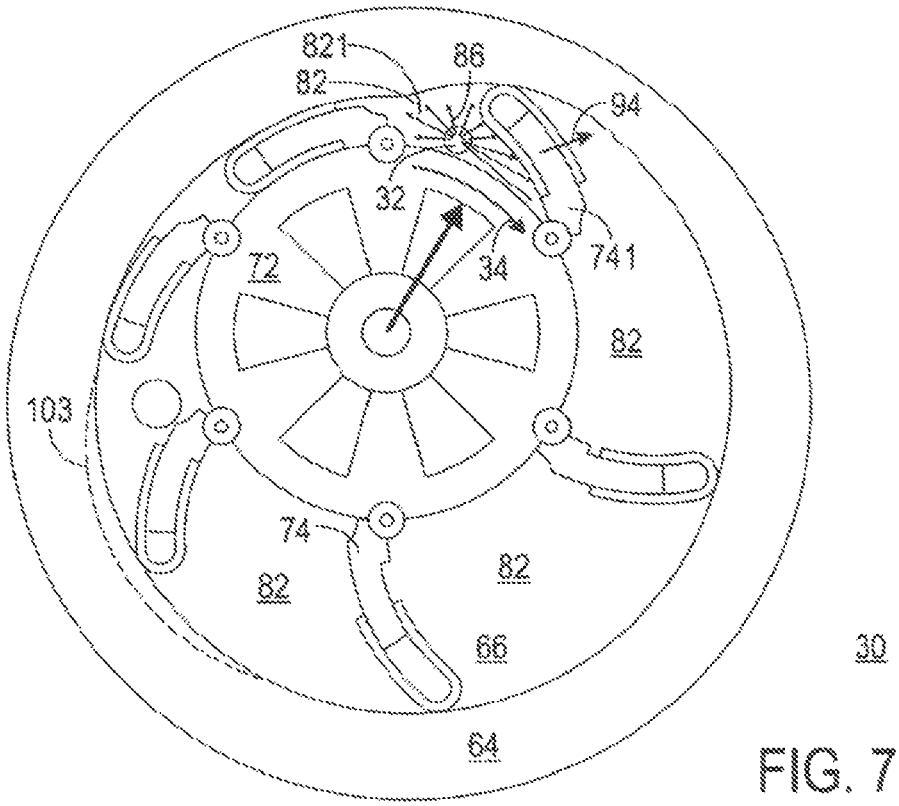
FIG. 7 shows a side view of the expansion chamber FIG. 1 (with one end plate removed) during operation with a reference cell at a 1 o'clock position accordance with a preferred embodiment of the present invention.
Figure 8:
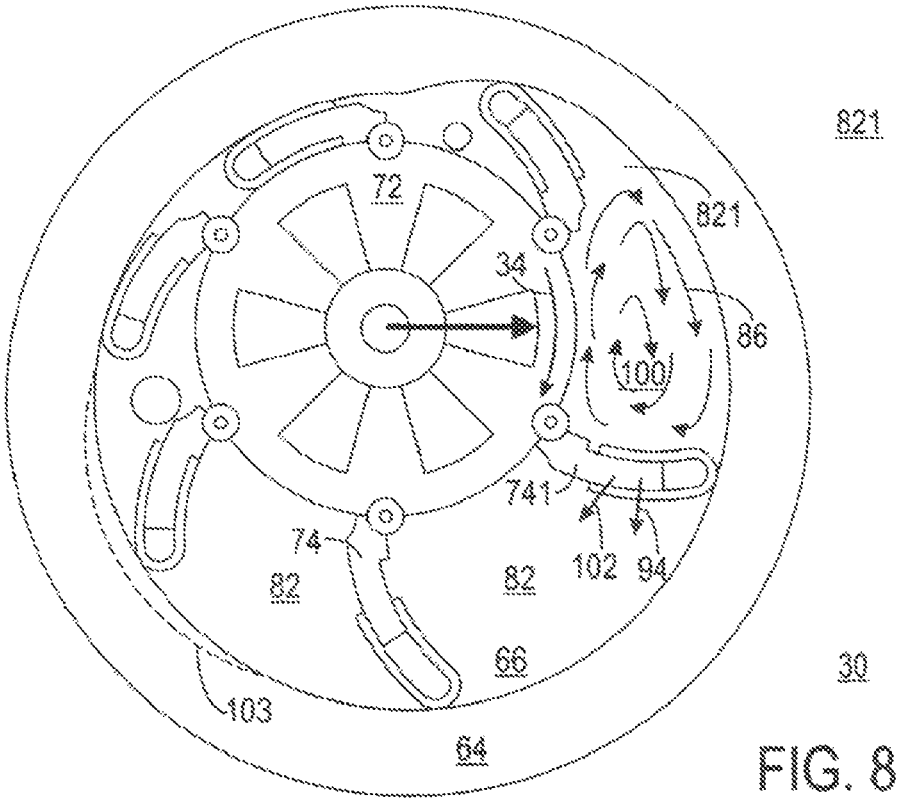
FIG. 8 shows a side view of the expansion chamber of FIG. 7 (with one end plate removed) during operation with the reference cell at a 3 o'clock position in accordance with a preferred embodiment of the present invention.
Figure 9:
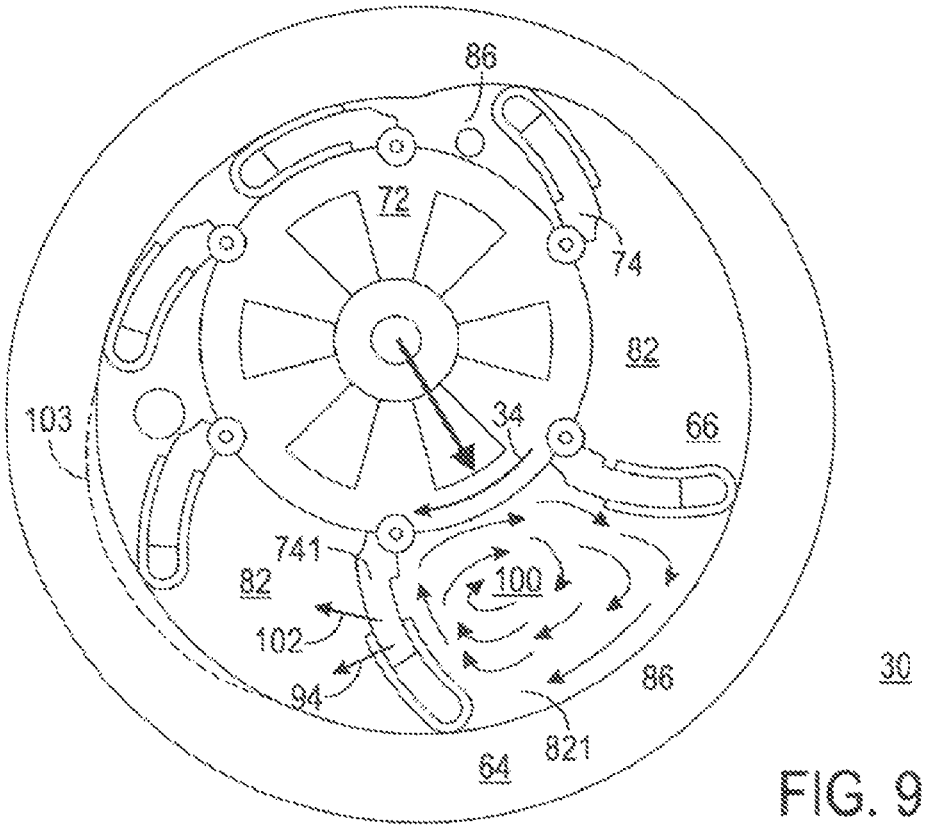
FIG. 9 shows a side view of the expansion chamber of FIG. 7 (with one end plate removed) during operation with the reference cell at a 5 o'clock position in accordance with a preferred embodiment of the present invention.

It may be observed from FIGS. 7, 8, and 9 that the preferred curvature of housing 64 is such that when reference cell 821 is in approximately the 1 o'clock position until when reference cell 821 is in approximately the 6 o'clock position, reference cell 821 increases in volume. This constitutes the power stroke of engine 20. This increase in volume allows energy to be obtained from the combination of vapor hydraulics and adiabatic expansion, i.e., from expansive and vortical forces 94 and 102. In order that a maximum use of energy may be obtained, it is desirable that the curvature of housing 64 relative to rotor 72 be such that the volume of space within reference cell 821 increase in the golden ratio Φ. The golden ratio is defined as a ratio where the lesser is to the greater as the greater is to the sum of the lesser plus the greater:

$$\frac{a}{b} = \frac{b}{a+b}.$$

Assuming the lesser, a, to be unity, then the greater, b, becomes ϕ:

$$\frac{1}{\phi} = \frac{\phi}{1+\phi}:$$

$$\phi^2 = \phi + 1:$$

$$\phi^2 - \phi - 1 = 0.$$

Using the quadratic formula (limited to the positive result):

$$\phi = \frac{1+\sqrt{5}}{2} \cong 1.618033989$$

Those skilled in the art will recognize this as the Fibonacci ratio. It will also be recognized from the theory of gases that adiabatic expansion can be maintained to a very high ratio, providing there is a relatively constant temperature (hence, the heating of expansion chamber 30 by block heater 88 (FIG. 1), and a relatively constant pressure provided by the seals of vanes 74 and rotor 72. Therefore, to extract the maximum energy from adiabatic expansion, the volume of reference cell 821 should increase according to the Fibonacci ratio. This is accomplished by the curvature of housing 64 in conjunction with the offset of rotor 72 within housing 64.

Figure 10:
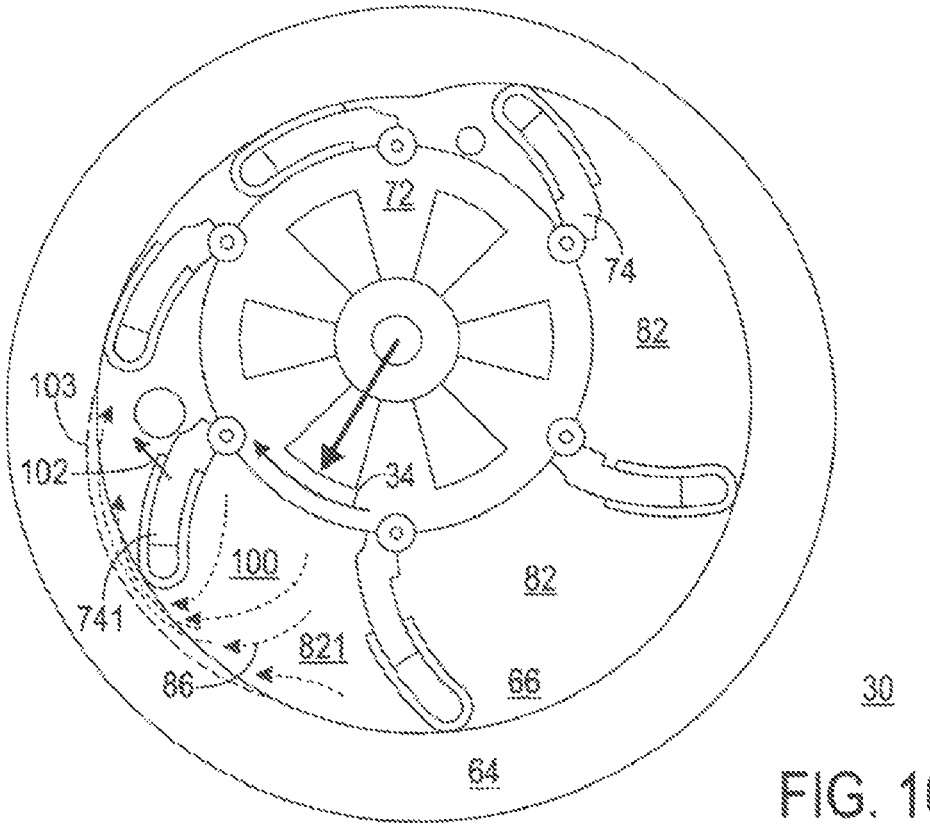
FIG. 10 shows a side view of the expansion chamber of FIG. 7 (with one end plate removed) during operation with the reference cell at a 7 o'clock position in accordance with a preferred embodiment of the present invention.
Figure 11:
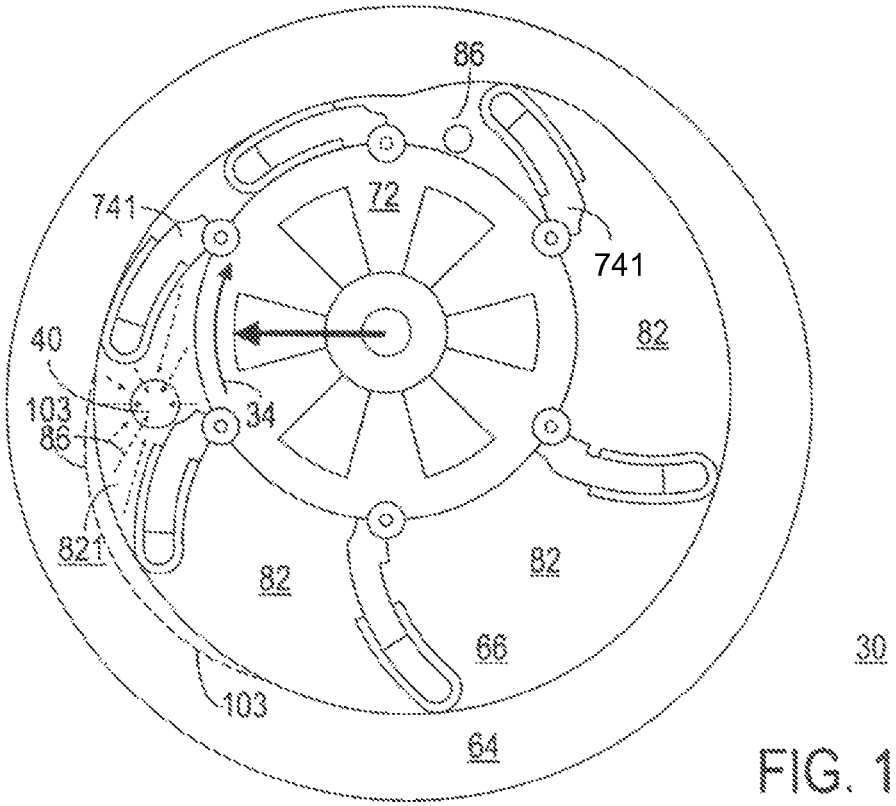
FIG. 11 shows a side view of the expansion chamber of FIG. 7 (with one end plate removed) during operation with the reference cell at a 9 o'clock position in accordance with a preferred embodiment of the present invention.
Figure 12:
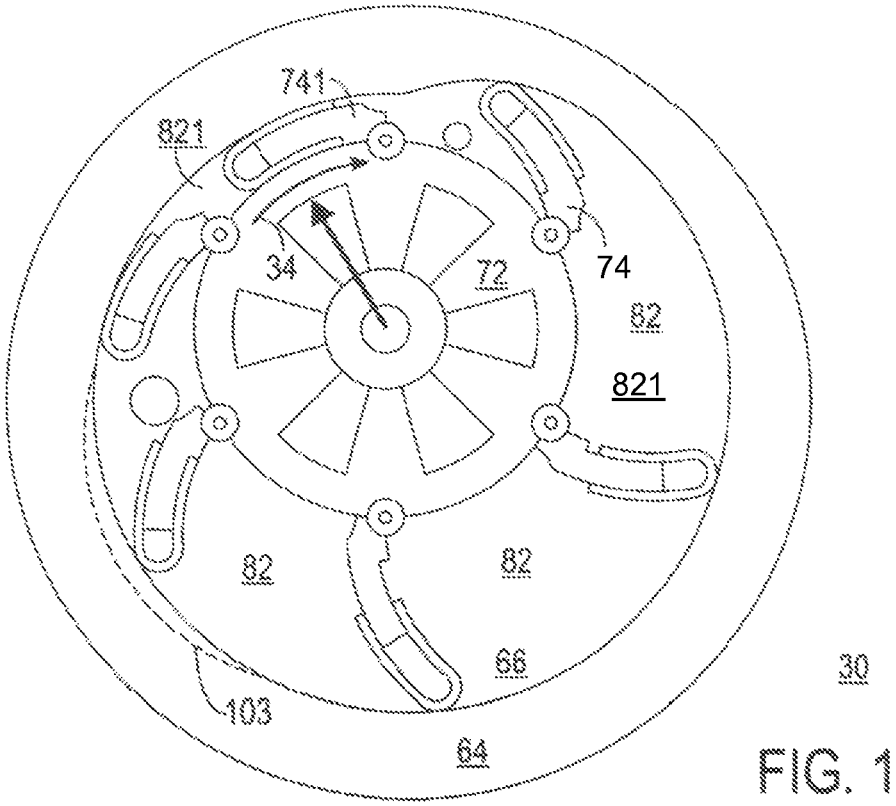
FIG. 12 shows a side view of the expansion chamber of FIG. 7 (with one end plate removed) during operation with the reference cell at an 11 o'clock position in accordance with a preferred embodiment of the present invention.

Tasks 144 and 152, i.e., the adiabatic expansion plasma 86 and the generation of vortex 100, continue throughout the power cycle of engine 20. Once the power cycle is complete, at nominally the 6 o'clock position, reference cell 821 decreases in volume as rotation 34 continues. In a task 154, plasma 86 is then exhausted from reference cell 821 through exhaust grooves 103 cut into the inside of expansion chamber 30 and/or end plates 66 and/or 68 (not shown), and thence through outlet port 40 (FIGS. 10 and 11). In a task 156, the exhausted plasma 86 is condensed by condenser 42 to become plasmatic fluid 22 and returns to reservoir 24. Rotation 34 continues until reference cell 821 is again at the 1 o'clock position.

Those skilled in the art will appreciate that the hereinbefore-discussed cycle of reference cell 821 (FIGS. 7, 8, 9, 10, 11, and 12) is representative of only one cell 82. As depicted in the Figures, expansion chamber has six cells 82. As each cell 82 reaches the 1 o'clock position (FIG. 7), that cell 82 becomes reference cell 821 and proceeds through the discussed tasks. Therefore, at any given time during operation process 120, every cell 82 between the 1 o'clock position (FIG. 7) and the 9 o'clock position (FIG. 11) inclusively, contains plasma 86 and is represented by reference cell 821 at some portion of its cycle.

Figure 13:
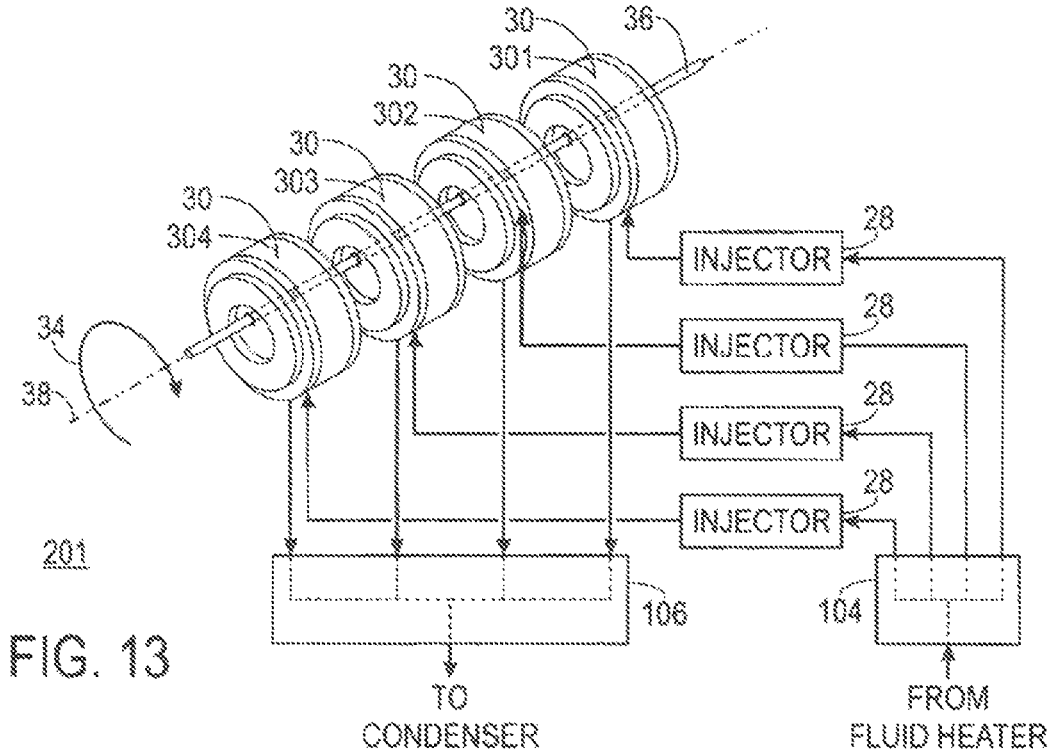
FIG. 13 shows a schematic view of a multi-chamber plasma-vortex engine in accordance a preferred embodiment the present invention.
Figure 14:
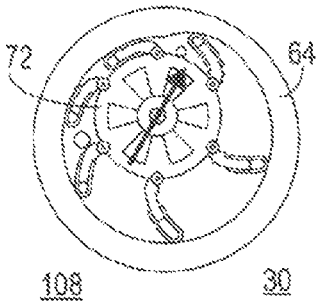
FIG. 14 shows an interior side view of an expansion chamber for the plasma-vortex engine of FIG. 13 in a 1 o'clock state in accordance with a preferred embodiment of the present invention.
Figure 15:
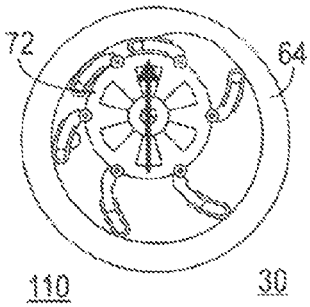
FIG. 15 shows an interior side view of an expansion chamber for the plasma-vortex engine of FIG. 13 in a 12 in o'clock state in accordance with a preferred embodiment of the present invention.
Figure 16:
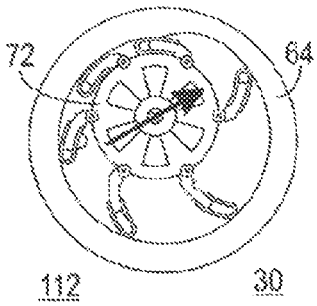
FIG. 16 shows an interior side view of an expansion chamber for the plasma-vortex engine of FIG. 13 in a 2 o'clock state in accordance with a preferred embodiment of the present invention.

FIG. 13 shows a schematic view of a four-chamber plasma-vortex engine 201 in accordance with a preferred embodiment of the present invention. FIGS. 14, 15, and 16 show interior side views of expansion chambers 30 for plasma-vortex engine 201 in a 1 o'clock state 108 (FIG. 14), a 12 o'clock state 110 (FIG. 15), and a 2 o'clock state 112 (FIG. 16) in accordance with a preferred embodiment of the present invention. The following discussion refers to FIGS. 1, 2, 3, 13, 14, 15, and 16.

In the four-chamber engine of FIG. 13, there are four substantially identical expansion chambers 30 coupled to a common shaft 36. In order to differentiate the four expansion chambers 30, they are labeled 301, 302, 303, and 304.

Each of the four expansion chambers 301, 302, and 304 is injected with plasmatic fluid 22 through a separate injector 28. Injectors 28 are fed from an intake manifold 104, which is in turn fed from fluid heater 26 (FIG. 1).

The output of each of expansion chambers 301, 302, 303, and 304 passes to an exhaust manifold 106, and then to condenser 42 (FIG. 1) for condensation and reuse.

Rotors 72 are coupled to shaft 36 in a specific pattern. The rotors 72 within expansion chambers 302 and 304 are displaced approximately 30° from the rotors 72 within expansion chambers 301 and 303.

When expansion chamber 301 has a cell 82 in a first state 108 (FIG. 14), i.e., the 1 o'clock position and ready to receive plasmatic fluid 22, then expansion chamber 302 has a cell 82 in a second state 110 (FIG. 15), i.e., the 12 o'clock position, approximately 30° in advance of the first state 108 (FIG. 13). When the cell 82 in expansion chamber 301 has advanced to a third state 112 (FIG. 16), i.e., the 2 o'clock position, approximately 30° past the first state 108, then the cell 82 in expansion chamber 302 has advanced to the first state 108 (FIG. 14) and is ready to receive plasmatic fluid 22. Expansion chambers 303 and 304 operate as do expansion chambers 301 and 302, respectively.

There are four expansion chambers 30, and each of the four expansion chambers 30 has six cells 82. Therefore, displacing the rotors 72 of expansion chambers 302 and 304 by 30° relative to the rotors 72 of expansion chambers 301 and 303 allows for smooth operation with plasmatic fluid 22 being injected into two of expansion chambers 30 approximate every 30° of rotation.

In an alternative embodiment (not shown), even smoother operation may be obtained by displacing the rotor 72 of expansion chambers 302 by approximately 15° relative to the rotor 72 of expansion chamber 301, displacing the rotor 72 of expansion chambers 303 by approximately 15° relative to the rotor 72 of expansion chamber 302, and by displacing the rotor 72 expansion chamber 304 by approximately 15° relative to the rotor 72 of expansion chamber 303. This allows for operation with plasmatic fluid 22 being injected into two of expansion chambers 30 approximately every 15° of rotation.

Figure 18:
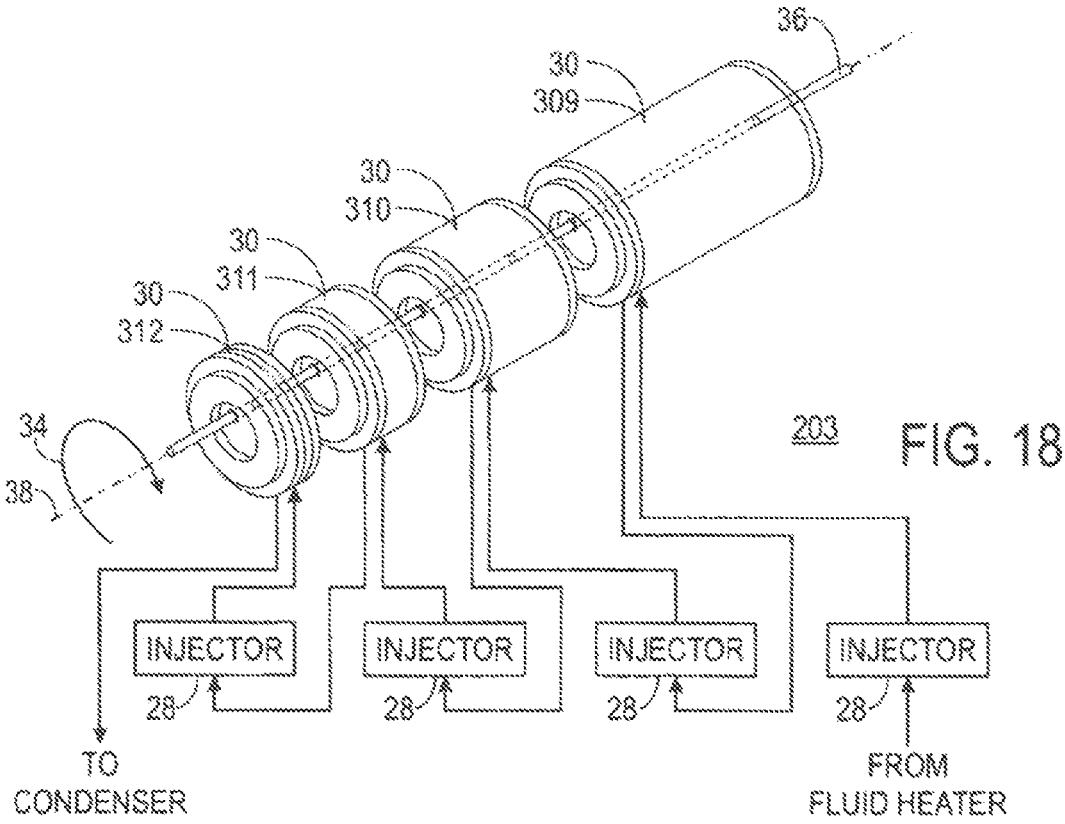
FIG. 18 shows a schematic view of a cascading plasma-vortex engine with variant chamber depths in accordance with a preferred embodiment of the present invention.
Figure 17:
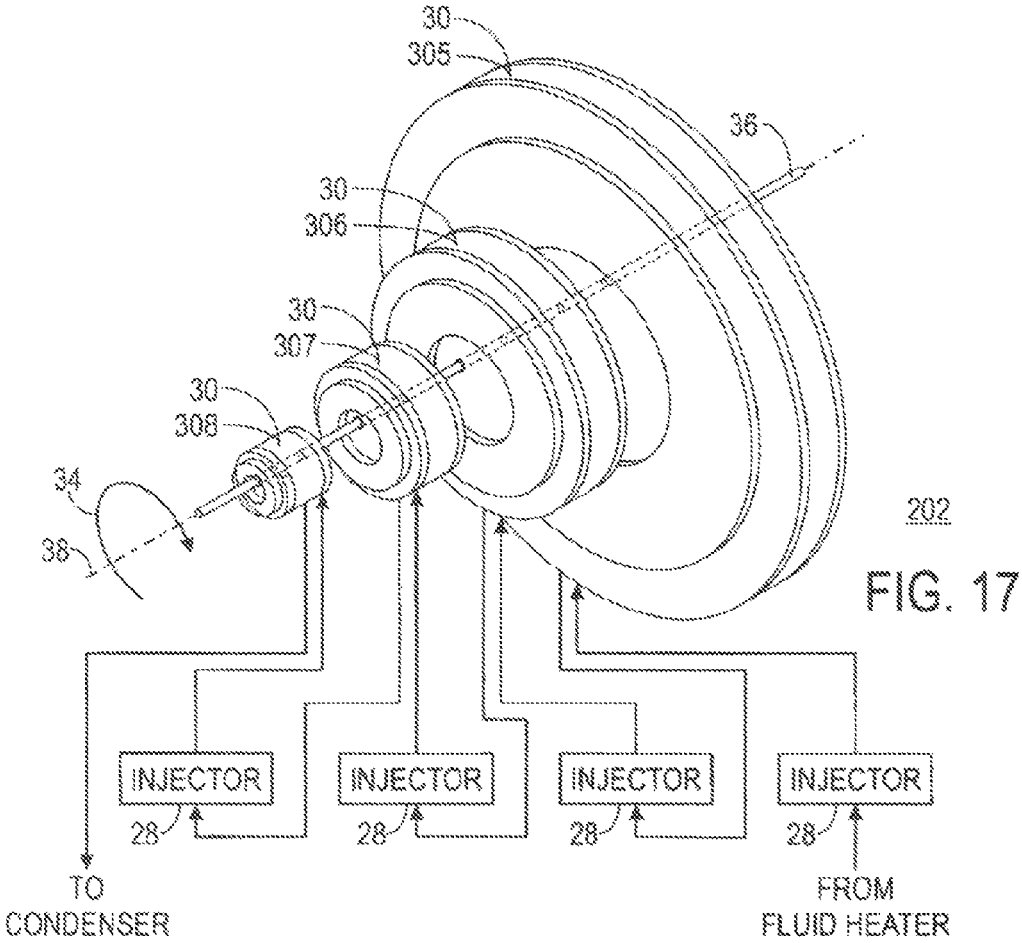
FIG. 17 shows a schematic view of a cascading plasma-vortex engine with variant chamber diameters in accordance with a preferred embodiment of the present invention.

FIGS. 17 and 18 show schematic views of cascading plasma-vortex engines 202 and 203 with variant chamber diameters (FIG. 17) and variant chamber depths (FIG. 18) in accordance with preferred embodiments of the present invention. The following discussion refers to FIGS. 1, 2, 3, 13, 14, 15, 16, 17, and 18.

The cascading four-chamber engine 202 of FIG. 17 is substantially identical to the four-chamber engine 201 of FIG. 13 (discussed hereinbefore) except for the diameters of the expansion clambers 30 and the path of plasma 86. In order to differentiate the four expansion chambers 30 of engine 202, they are labeled 305, 306, 307, and 308.

Similarly, the cascading four-chamber engine 203 of FIG. 18 is substantially identical to the cascading four-chamber engine 202 of FIG. 17 except for the depths of the expansion chambers 30. In order to differentiate the four expansion chambers 30 of engine 203, they are labeled 309, 310, 311, and 312.

In engine 202, all expansion chambers 30 have substantially the same depth. The volume of each expansion chamber 30 is therefor a function of the diameter of that expansion chamber 30. Conversely, in engine 203, all expansion chambers 30 have substantially the same diameter. The volume of each expansion chamber 30 is therefor a function of the depth of that expansion chamber 30.

The following discussion assumes an exemplary embodiment of engine 202 or 203 wherein each expansion chamber extracts approximately 70 percent of the potential energy from plasma 86. Plasma 86 is first passed from fluid heater 26 (FIG. 1) and injected into first expansion chamber 305 or 309. Expansion chamber 305 or 309 has a predetermined volume. Experimentation has shown that the exhausted plasma 86 from expansion chamber 305 or 309 has lost approximately 70 percent of its initial potential adiabatic energy.

The exhausted plasma 86 from expansion chamber 305 or 309 is then injected into expansion chamber 306 or 310. Expansion chamber 306 or 310 has substantially one-fourth the volume of expansion chamber 305 or 309. The exhausted plasma 86 from expansion chamber 306 or 310 has again lost approximately 70 percent of its potential adiabatic energy, or approximately 91 percent of its original potential adiabatic energy.

The exhausted plasma 86 from expansion chamber 306 or 310 is then injected into expansion chamber 307 or 311. Expansion chamber 307 or 311 has substantially one-fourth the volume of expansion chamber 306 or 310 (i.e., substantially one sixteenth that of expansion chamber 305 or 309). The exhausted plasma 86 from expansion chamber 306 or 310 has again lost approximately 70 percent of its potential adiabatic energy, or approximately 97 percent of its original potential adiabatic energy.

The exhausted plasma 86 from expansion chamber 307 or 311 is then injected into expansion chamber 308 or 312. Expansion chamber 308 or 312 has substantially one-fourth the volume of expansion chamber 307 or 311 (i.e., substantially one thirty-second that of expansion chamber 305 or 309). The exhausted plasma 86 from expansion chamber 307 or 311 has again lost approximately 70 percent of its potential adiabatic energy, or approximately 99 percent of its original potential adiabatic energy.

This very exhausted plasma 86 is then passed to condenser 42 (FIG. 1 to be condensed and recirculated.

In this manner, cascading plasma-vortex engines 202 and 203 derive a maximal amount of energy from plasmatic fluid 22.

Those skilled in the art will appreciate that the four-chamber embodiments of FIGS. 13, 17, and 18 discussed hereinbefore are exemplary only. The use of multi-chamber embodiments having other than four expansion clambers 30 (i.e., six chambers) does not depart from the spirit of the present invention.

Figure 19:
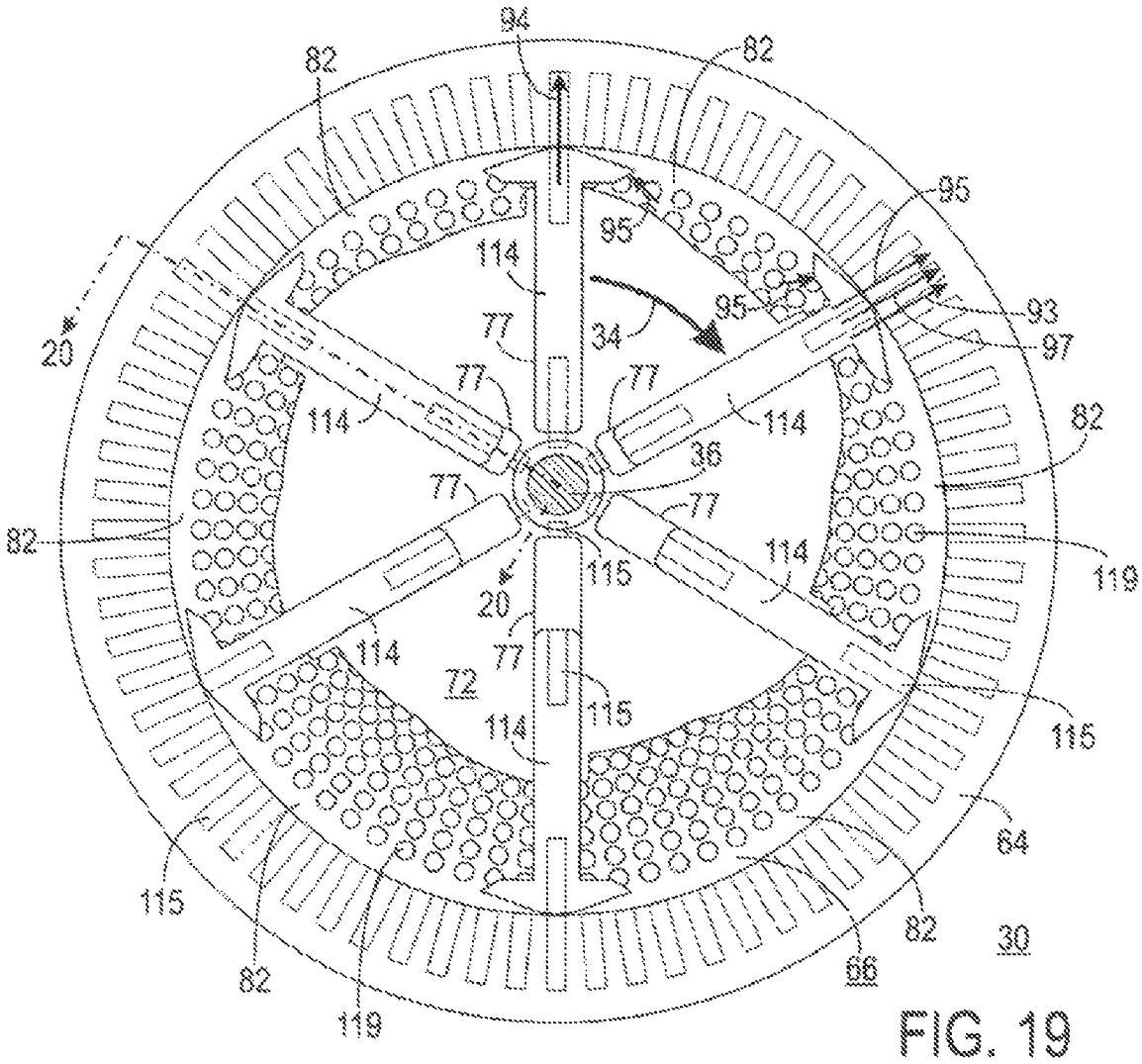
FIG. 19 shows a simplified side view of the expansion chamber of FIG. 3 with T-form vanes and with one end plate removed in accordance with a preferred embodiment of the present invention.
Figure 20:
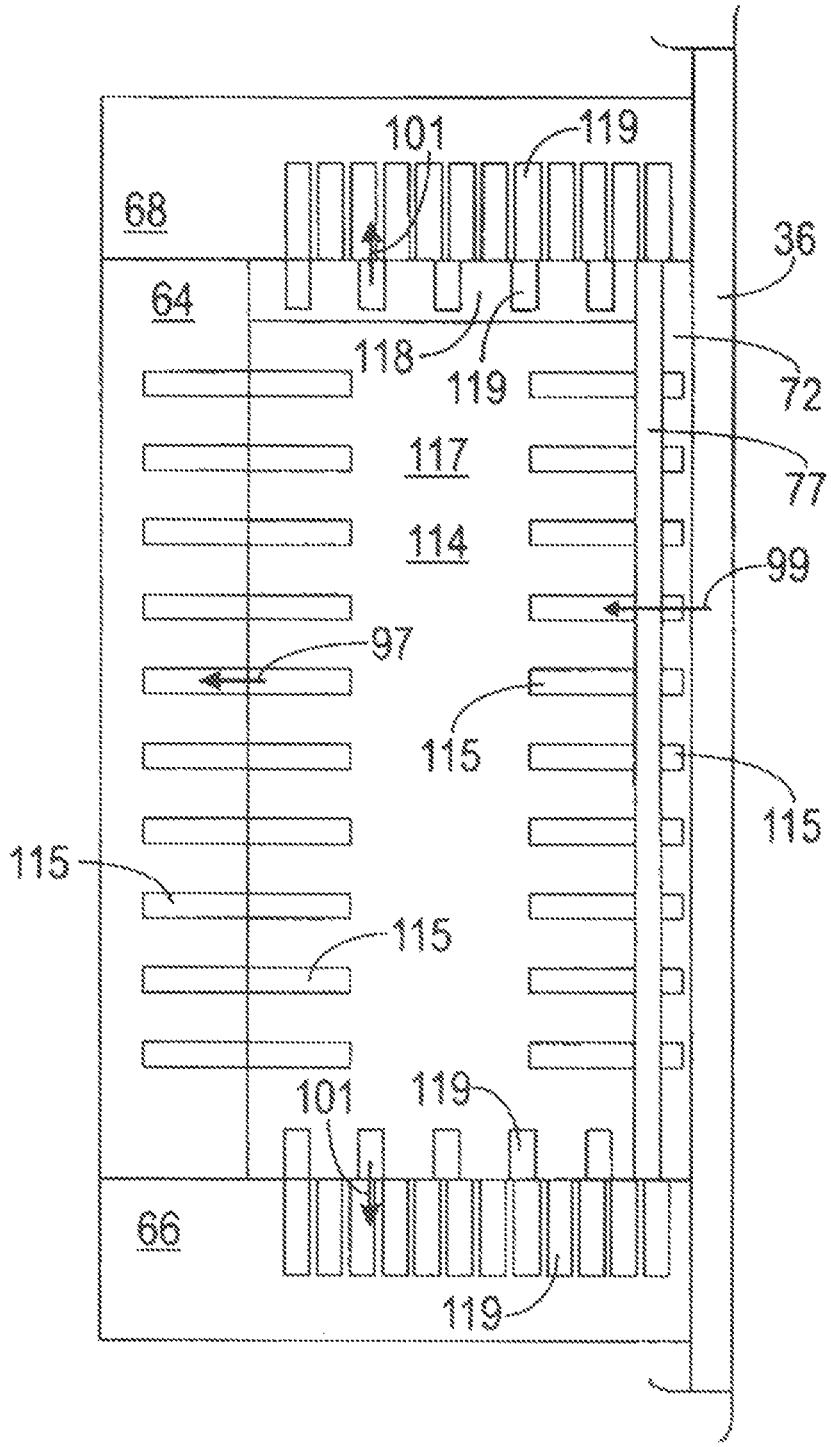
FIG. 20 shows a simplified cross-sectional view of one cell of the expansion chamber of FIG. 19 taken at line 20-20 and demonstrating magnetic vane positioning in accordance with a preferred embodiment of the present invention.

FIG. 19 shows a simplified side view of the expansion chamber of FIG. 3 with T-form vanes 114 with only one end plate 66 depicted in accordance with a preferred embodiment of the present invention. FIG. 20 shows a simplified cross-sectional view of one cell 82 of expansion chamber 30 taken at line 20-20 and demonstration magnetic vane positioning. The following discussing refers to FIGS. 5, 19, and 20.

In an alternative embodiment, sliding vanes 75 of FIG. 5 may be replaced with sliding T-form vanes 114 of FIG. 19. T-form vanes 114 may operate in a manner substantially similar to that described hereinbefore for sliding vanes 75, i.e., through the use of vane extension 81 and vane base 79. Preferably, though, the relative sizes of rotor 72 and T-form vanes 114 may be such that no vane extension or vane base is needed. This allows a simpler magnetic attraction/repulsion mechanism (discussed hereinafter) to be utilized.

With sliding vanes 75, sliding vane 75 is held against an inside of housing 64 by a combination of the action of vane base 79 and vane extension 81, typically a spring action, and rotational forces 93 (i.e., centrifugal force). With T-form vanes 114, this rotational force 93 remains. In addition to rotational force 93, the injection of plasma 86 into expansion cell 82 (discussed hereinbefore and demonstrated in FIG. 7) produces a plasmatic force 95 that is impressed upon the back side of the T-head of the vanes 114. This plasmatic force maintained throughout the power portion of the cycle and may be considered a combination expansive force 94 and vertical force 102 (both discussed hereinbefore).

The application of plasmatic force 95 to a T-form vane 114 serves to produce a better seal between that T-form vane and the inner surface of housing 64.

It is desirable that T-form vanes 114 additionally be made to form the best possible seal against the inner surface of housing 64. Therefore, in addition to a seal formed by rotational force 93 and plasmatic force 95, it is desirable that an attractive force 97 be employed to inherently attract vane 114 to housing 64.

A magnetic field may be induced in each of housing 64 and the T-head of vane 114 through the embedding of magnets 115, or other means well known to those of ordinary skill in the art, so as form attractive magnetic force 97 that attracts that vane 114 towards housing 64.

Those of ordinary skill in the art will appreciate that housing 64 and vanes 114 are desirably fabricated of a non-magnetic material (e.g., a copper alloy, such as brass or bronze, or a thermoplastic, such as the polyamide-imide Torlon® of Solvay Advanced Polymers, LLC.) so as to optimize attractive force 97. This is not a requirement of the present invention, however, and magnetic materials may be used for either housing 64 and vanes 114 without departing from the spirit of the present invention.

Alternatively, attractive force 97 may also readily be realized if housing 64 is fabricated of a magnetic material (e.g., steel or other iron alloy). In this embodiment, not shown in the Figures, the natural magnetic attraction between the magnetic field of vanes 114 and the material of housing 64 would constitutes attractive force 97.

Other magnetic fields may be developed in vane 114 and rotor 72 by embedding magnets 115 in vane 114 and rotor 72 proximate an inner end of vane channel 77, or by other means well known to those of ordinary skill in the art. If these magnetic fields are appropriately oriented, a repulsive magnetic force 99 may be generated between rotor 72 and each vane 114 generated that drives vanes 114 away from shaft 36 (i.e., towards housing 64). Repulsive force 99 works in concert with attractive force 97, and with rotational and plasmatic forces 93 and 95, to seal vane 114 against housing 64.

Those of ordinary skill in the art will appreciate that rotor 72 is desirably fabricated of a non-magnetic material so as to optimize repulsive force 99. This is not a requirement of the present invention, however, and a magnetic material may be used for rotor 72 without departing from the spirit of the present invention.

Those skilled in the art will appreciate that magnetic vane positioning and the use of attractive and repulsive forces 97 and 99, while discussed herein in relation to T-form vanes 114, may also be used with sliding vanes 75 (FIG. 5) without departing from the spirit of the present invention.

Expansion chamber 30, as depicted in the Figures, incorporates housing 64 and first and second end plates 66 and 68. It is highly desirable that T-form vanes 114 (or sliding vanes 75) form optimal seals not only with housing 64, but with end plates 66 and 68. This may be accomplished by structuring vanes 114 so as to consist of a vane body 117 and a vane cap 118, where vane cap 118 is loosely coupled to vane body 117 proximate one of end caps 66 or 68 in a substantially gas-tight manner.

As discussed hereinbefore in conjunction with housing 64 and vanes 114, magnetic fields may be produced in each of end plates 66 and 68, and in vane body 117 and vane cap 118 by embedding "plate" magnets 119, or other means well known to those of ordinary skill in the art. These magnetic fields may exert a secondary attractive magnetic force 101 between end plates 66 and 68 and vane body and cap 117 and 118, respectively, and thereby improving the seal between vane 114 and end plates 66 and 68.

Those of ordinary skill in the art will appreciate that endplates 66 and 68 are desirably fabricated of a non-magnetic material so as to optimize secondary attractive force 101. This is not a requirement of the present invention, however, and a magnetic material may be used for end plates 66 and 68 without departing from the spirit of the present invention.

Again, in an alternative embodiment not shown in the figures, secondary attractive force 101 may readily be realized if end plates 66 and 68 are fabricated of a magnetic material. In this embodiment, the natural magnetic attraction between plate magnets 119 in vane body 117 and vane cap 118 and the material of end plates 66 and 68 would constitute secondary attractive force 101.

It will be evident to those skilled in the art that plate magnets 119 differ in kind from magnets 115 only in their orientation. For each vane 114, "primary" attractive force 97, produced by magnets 115, is substantially in a plane of that vane 114 and directed towards housing 64. Secondary attractive forces 101, produced by plate magnets 119, are also substantially the plane of that vane 114, but substantially perpendicular to plane of that vane 114, but substantially perpendicular to primary attractive force 97 and directed towards end plates 66 and 68.

In an alternative embodiment (not shown in the Figures), vane 114 may consist of vane body 117 and two vane caps 118, one proximate each of end plates 66 and 68. The use of two vane caps 118 does not depart from the spirit of the present invention.

It will also be appreciated by those of skill the art that the use of one or two vane caps 118 is applicable to pivoting vanes 74 (FIG. 4) and sliding vanes 75 (FIG. 5) without departing from the spirit of the present invention.

Those of skill in the art will also appreciate that the pluralities of magnets 115 or 119 in vane 114, vane cap 118, and/or rotor 72 may individually and/or collectively be replaced by single magnets of an appropriate structure and orientation without departing from the spirit of the present invention.

It will also be appreciated by those skilled in the art that the pluralities of magnets 115 and/or 119 embedded in any one or combination of housing 64, end plates 66 and 68, vanes 114, vane bodies 117, vane caps 118, and rotor 72 may be replaced by appropriate field(s) generated by electromagnets or other means without departing from the spirit of the present invention.

In summary, the present invention teaches a plasma-vortex engine 20 and method of operation 120 therefor. Plasma-vortex engine 20 is a rotary engine utilizing external combustion. Plasma-vortex engine 20 also utilizes adiabatic gas expansion at moderate temperatures and pressures.

Although the preferred embodiments of the invention have been illustrated and described in detail, it will be readily apparent to those skilled in the art that various modifications may be made therein without departing from the spirit of the invention or from the scope of the appended claims.

The invention claimed is:

1. A rotary engine, comprising:

a series of expansion cells formed between:

a housing on an outer side of said series of expansion cells;

a first end plate affixed to a first edge of said housing;

a rotor on an inner side of said series of expansion cells, said rotor comprising an outer surface proximate said series of expansion cells; and a second end plate affixed to a second edge of said housing, said first endplate parallel said second endplate; and a series of sliding T-form vanes coupled between said rotor and said housing;

at least one vane cap longitudinally aligned and in proximate contact with a longitudinal length of said body of said first T-form vane; and at least one vane cap magnet at least partially embedded in said vane cap, said vane cap magnet exerting a sealing force between said first T-form vane and said first end plate, the sealing force configured perpendicular to a sliding vector of said T-form vane, wherein said series of T-form vanes separate said series of expansion cells into individual expansion cells, each of said sliding T-form vanes directly or indirectly coupled to said rotor, wherein said rotor comprises at least one vane channel, said vane channel comprising parallel sides configured to receive at least one of said T-form vanes, wherein said at least one of said T-form vanes comprises a first T-form vane comprising a base end, a body, and a T-head, and wherein said T-head comprises a front side proximate said housing and a back side proximate one of said series of expansion cells, said back side of said T-head configured to periodically abut to said outer surface of said rotor proximate said series of expansion cells.

2. The engine of claim 1, wherein during use a vaporizing fluid exerts a force on said back side of said T-head, wherein said force pushes said at least one of said T-form vanes toward said housing.

3. The engine of claim 1, further comprising:

a first permanent magnet at least partially embedded in said base end of said first T-form vane; and a second permanent magnet at least partially embedded in said rotor, said first magnet magnetically repulsively aligned to said second magnet.

4. The engine of claim 3, wherein during use a repulsive force between said first magnet and said second magnet combines with an expansive force, produced by the vaporizing fluid exerting pressure on said back side of said T-head, to push said first T-form vane toward said housing.

5. The engine of claim 1, wherein said sealing force between said first T-form vane and said first end plate comprises a force on a first axis perpendicular to a second axis of sliding movement of said first T-form vane.

6. The engine of claim 1, further comprising:

a first magnet at least partially embedded in said base end of said first T-form vane;

a second magnet at least partially embedded in said rotor, said first magnet magnetically repulsively aligned to said second magnet;

at least one vane cap longitudinally aligned and in proximate contact with said body of said first T-form vane; and a vane cap magnet at least partially embedded in said vane cap, said vane cap magnet providing an attractive force between said end cap and said first end plate, said end cap magnet generating an attractive sealing force between said first T-form vane and said first end plate, wherein a first magnetic force between said first magnet and said second magnet is about mathematically perpendicular to a second magnetic force between said end cap magnet and said first end plate.

7. The engine of claim 1, wherein said first T-form vane comprises:

a leading wing protruding into a first of said series of expansion cells; and a trailing wing protruding into a second of said series of expansion cells.

8. The engine of claim 1, further comprising:

a fluid circulating sequentially through a heater, through said expansion cells, and through a condenser, wherein the fluid comprises at least a diamagnetic fluorocarbon liquid component and a solid paramagnetic component.

9. The engine of claim 8, wherein said solid paramagnetic component comprises at least magnetite, wherein said engine operates at internal temperatures below seven hundred fifty degrees Fahrenheit.

10. A rotary engine, comprising:

a series of expansion chambers formed between:

a housing on an outer side of said series of expansion chambers;

a first end plate affixed to said housing;

a rotor on an inner side of said series of expansion chambers, said rotor comprising an outer surface proximate said series of expansion chambers; and a second end plate affixed to said housing; and a series of sliding T-form vanes coupled between said rotor and said housing; and a first chamber of a multi-chamber engine, wherein output of said first engine comprises an input of a second engine of said multi-chamber engine, wherein output of said second engine comprises an input of a third engine of said multi-chamber engine, wherein a first width of an expansion chamber of said first engine is greater than a second width of an expansion chamber of said second engine, wherein said second width of said expansion chamber of said second engine is greater than a third width of an expansion chamber of said third engine, wherein said series of T-form vanes separate said series of expansion chambers into individual expansion chambers, each of said sliding T-form vanes directly or indirectly coupled to said rotor, wherein said rotor comprises at least one vane channel, said vane channel comprising parallel sides configured to receive at least one of said T-form vanes, wherein said at least one of said T-form vanes comprises a first T-form vane comprising a base end, a body, and a T-head, and wherein said T-head comprises a front side proximate said housing and a back side proximate one of said series of expansion chambers, said back side of said T-head configured to periodically abut to said outer surface of said rotor proximate said series of expansion chambers.

11. The engine of claim 1, further comprising a spring, a spring action of said spring configured to seal said first T-form vane against said housing.

12. A method for operation of a rotary engine using a vaporizing fluid, comprising the steps of:

separating an internal chamber within said rotary engine into a series of expansion cells with a series of sliding T-form vanes, said internal chamber formed between:

a housing circumferentially surrounding said internal chamber;

a first end plate affixed to a first edge of said housing; and a second end plate affixed to a second edge of said housing, wherein said series of sliding T-form vanes couple between a rotor within said internal chamber and said housing, wherein said rotor comprises an outer surface proximate said series of expansion cells, and wherein said rotor comprises at least one vane channel, said vane channel comprising parallel sides configured to receive at least one of said T-form vanes; and circulating a fluid sequentially through a heater, through said expansion cells, and through a condenser, wherein the fluid comprises at least a diamagnetic fluorocarbon liquid component and a solid paramagnetic component in the fluid, wherein each of said sliding T-form vanes directly or indirectly couple at least one of said rotor and said housing, wherein at least one of said T-form vanes comprises a first T-form vane comprising a base end, a body, and a T-head, wherein said T-head comprises a front side proximate said housing and a back side proximate one of said series of expansion cells, said back side of said T-head configured to periodically abut to said outer surface of said rotor proximate said series of expansion cells, and wherein said first T-form vane comprises:

a leading wing shape protruding into a first of said series of expansion cells; and a trailing wing shape protruding into a second of said series of expansion cells.

13. The method of claim 12, further comprising the step of:

exerting a force on said back side of said T-head, said force generated by vaporizing a circulating fluid, wherein said force pushes said at least one of said T-form vanes toward said housing.

14. The method of claim 12, further comprising the step of:

applying an outward force on said first T-form vane.

15. The method of claim 14, wherein said outward force comprises:

a repulsive magnetic force between a first magnet at least partially embedded in said base end of said first T-form vane and a second magnet at least partially embedded in said rotor.

16. The method of claim 15, wherein during said repulsive magnetic force between said first magnet and said second magnet combines with an expansive force, produced by the vaporizing fluid exerting pressure on said back side of said T-head to push said first T-form vane toward said housing.

17. The method of claim 14, wherein said outward force comprises:

a spring action from a spring coupled between said rotor and said first T-form vane.

18. The method of claim 12, further comprising the steps of:

applying a first sealing force between said T-form vane and said housing, said first sealing force comprising a repulsive magnetic force between a first magnet at least partially embedded in said base end of said first T-form vane and a second magnet at least partially embedded in said rotor; and applying a second sealing force between said T-form vane and said first end plate, said second sealing force comprising a second magnetic force between a third magnet and said first end plate, said third magnet at least partially embedded in a vane cap longitudinally aligned and in proximate contact with said body of said first T-form vane wherein said repulsive magnetic force and said second magnetic force comprise an about normally alignment.

19. The method of claim 12, further comprising the steps of:

applying a first sealing force between said T-form vane and said housing, said first sealing force comprising a spring force between said rotor and said first T-form vane; and applying a second sealing force between said T-form vane and said first end plate, said second sealing force comprising a magnetic force generated by a magnet at least partially embedded in a vane cap, said vane cap longitudinally aligned and in proximate contact with said body of said first T-form vane, wherein said first sealing force comprises an about perpendicular orientation to said second sealing force.

20. The method of claim 12, further comprising the steps of:

routing output of said rotary engine to an input of a first cascading rotary engine; and routing output of said first cascading rotary engine to an input of a second cascading rotary engine.

21. The method of claim 12, further comprising the step of:

exerting a rotation force on said first T-form vane, wherein said rotation force comprises a combination of:

an expansive force, wherein said expansive force comprises an about adiabatic expansion of said vaporizing fluid; and a vortical force, wherein said vortical force comprises an about rotational movement of said vaporizing fluid within said first of said series of expansion cells.

* * * * *